United States Patent [19]

Salmon

[11] Patent Number: 5,075,920

[45] Date of Patent: Dec. 31, 1991

[54] CLEANING ATTACHMENT

[75] Inventor: Carl Salmon, Unit 3, 646 Village Parkway, Unionville, Ontario, L3R 2S7, Canada

[73] Assignee: Carl Salmon, Unionville Ontario, Canada

[21] Appl. No.: 535,591

[22] Filed: Jun. 8, 1990

Related U.S. Application Data

[62] Division of Ser. No. 129,530, Dec. 7, 1987, Pat. No. 4,951,346.

[30] Foreign Application Priority Data

Jun. 2, 1987 [CA] Canada ..... 538642

[51] Int. Cl.[5] ..... A47L 5/38

[52] U.S. Cl. ..... 15/302; 15/322; 15/314

[58] Field of Search ..... 15/321, 322, 314, 302

[56] References Cited

U.S. PATENT DOCUMENTS

| | | | |
|---|---|---|---|
| 965,315 | 7/1910 | Moorehead | 15/322 |
| 2,649,927 | 8/1953 | De J. Ortega | 15/353 X |
| 2,867,231 | 1/1959 | Gerstmann | 15/353 X |
| 2,989,769 | 6/1961 | Houser | 15/353 |
| 3,173,164 | 3/1965 | Congdon | 15/353 X |
| 3,180,071 | 4/1965 | Nolte | 55/216 X |
| 3,705,437 | 12/1972 | Rukavina et al. | 15/314 X |
| 3,774,262 | 11/1973 | Anthony et al. | 15/322 |
| 4,158,248 | 6/1979 | Palmer | 15/321 |
| 4,580,309 | 4/1986 | Ogden | 15/302 X |
| 4,800,613 | 1/1989 | Blase et al. | 15/321 |

*Primary Examiner*—Chris K. Moore

*Attorney, Agent, or Firm*—Neil H. Hughes; Ivor M. Hughes

[57] ABSTRACT

A standard size receptacle for use with a vacuum system, said receptacle extending through a wall, the receptacle carrying a housing for fastening to a wall, the housing having disposed therein a fluid supply and a vacuum inlet, the fluid supply incorporating a quick connect and a check valve.

1 Claim, 7 Drawing Sheets

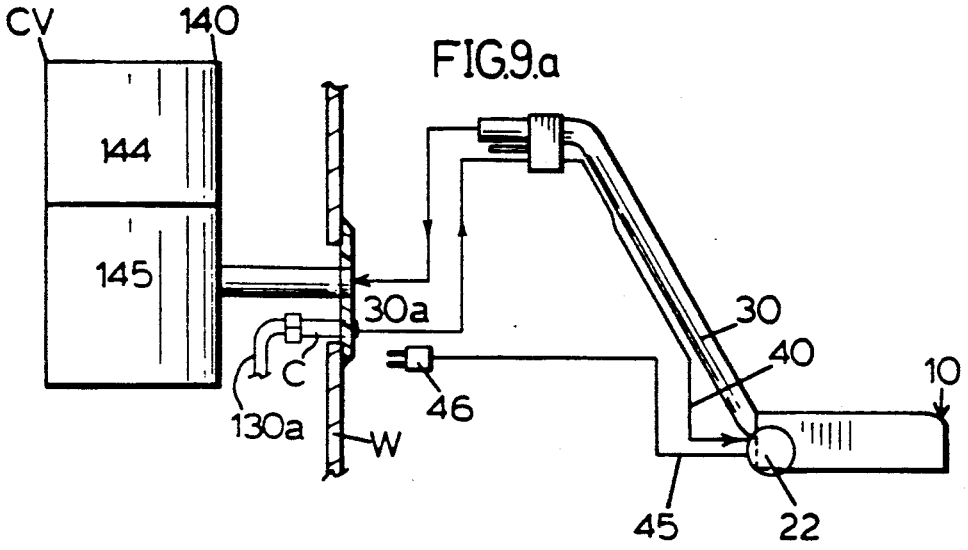
FIG.9.a
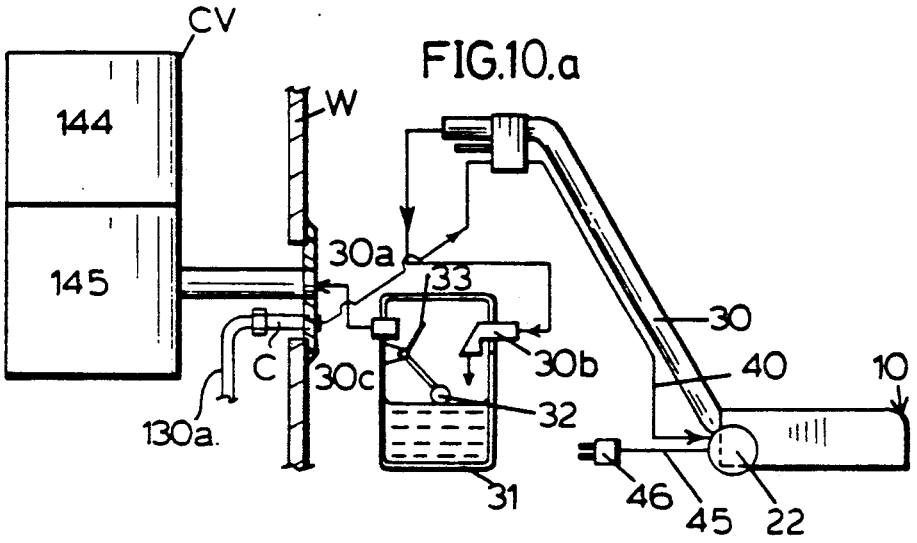
FIG.10.a
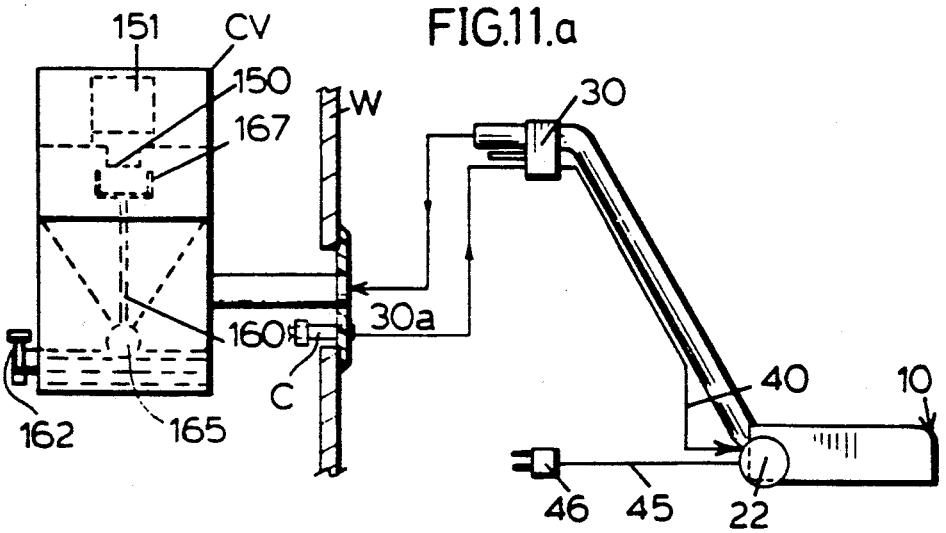
FIG.11.a

CLEANING ATTACHMENT

This is a division of application Ser. No. 07/129,530, filed Dec. 7, 1987, now U.S. Pat. No. 4,951,346, issued Aug. 28, 1990.

FIELD OF INVENTION

This invention relates to vacuum devices used in cleaning surfaces and more specifically to those used in cleaning carpets.

BACKGROUND OF THE INVENTION

Vacuum cleaners of numerous configurations are known. Some are used primarily in industrial applications, while others are designed primarily for residential use. Numerous attachments have been developed for each specific design ranging from nozzles to clean unaccessable ledges, to rug shampooing attachments for more exotic vacuum cleaners. Acquiring a multiplicity of attachments can be very costly and there is a great economy available if the number of attachments can be minimized. Further, changing the attachments for the more exotic models can be quite tedious particularly, when removing a rug beating vacuum head and substituting a rug shampooing attachment.

U.S. Pat. No. 4,266,000 by Tribolet describes a hot water extraction system providing both vacuum and hot water application from a faucet used in the application and extraction of liquids when cleaning a rug. The system described includes components for the conversion of the vacuum (as illustrated in FIG. 2) to the extraction system as illustrated in FIG. 3. The entire system must be dismantled or assembled depending on the mode of operation being used.

U.S. Pat. No. 27,492 by Howerin et al illustrates in FIG. 2 a cleaning head used with the machine of the aforementioned patent. Nozzles are provided to spray the carpet at 40 and a vacuum part is provided with a reduced cross section opening as required when picking up wet materials. Such a machine would not be practical to use when only vacuuming a carpet is required.

U.S. Pat. No. 3,496,592 by Jones describes an apparatus for cleaning and partially drying carpets having a head as illustrated in FIG. 5 which has a nozzle for application of the liquid and a suction nozzle for extraction of the spent liquid. Again, such a head would not be practically used for vacuuming carpets as well.

U.S. Pat. No. 4,433,451 by Parisi describes a cleaning head as best illustrated in FIGS. 4, 5 and 6, having suction means, brush means, and a steam generator used in cleaning carpets. U.S. Pat. No. 4,019,218 by Cyphert describes a carpet soil extractor as best illustrated in FIG. 1, and FIG. 4 providing a suction nozzle at 55 of reduced cross section as typically found in such extractor units. U.S. Pat. No. 4,096,601 by Knestele further describes a cleaning apparatus having a rotating brush, for cleaning carpets and other upholstery.

Nowhere within the prior art is found a cleaning attachment which is simple in construction which may be used to both dry vacuum a carpet and shampoo or wet clean a carpet. Attachments found in the prior art are designed specifically for one application or the other. For example, a user will typically vacuum his/her carpet with a conventional rug beating vacuum head, then when having completed the dry vacuum cycle, a rug shampooer or exhaustor will be rented and used to wet clean or shampoo the carpet or upholstery being cleaned. In some instances, a purchased vacuum system may include separate rug beating attachments and shampooing attachments, the latter of which may be used to clean a carpet following a thorough vacuuming. Exchanging these attachments can be quite laborious and inconvenient especially when one is attempting to complete a cleaning project quickly and efficiently.

It is therefore an object of the present invention to provide a cleaning attachment for a powered cleaning unit which can be used to dry vacuum and wet clean or shampoo a surface without having to change attachments.

It is a further object of the present invention to provide efficient dry or wet cleaning of the surface and thus provide one attachment for both applications.

It is a further object of the present invention to provide an economical alternative to rug shampooers.

Further and other objects of the invention will become apparent to the man skilled in the art, when considering the following summary of the invention and the more detailed description of the preferred embodiments illustrated herein.

SUMMARY OF THE INVENTION

According to one aspect of the invention, an improved cleaning attachment for use with a powered cleaning unit in cleaning surfaces is provided, the cleaning attachment comprising a three dimensional frame having a top and bottom, the cleaning attachment having extending therefrom vacuum carrier means for conducting a created vacuum, the vacuum carrier means extending away from the three dimensional frame, the three dimensional frame having liquid supply means extending to a source of liquid supply away from the three dimensional frame, the liquid supply means having liquid distribution means connected thereto, the cleaning attachment having disposed therein, preferably proximate the bottom thereof, at least two vacuum pickup means, each having an opening therein, the opening extending substantially horizontally above a surface being cleaned, the at least two vacuum pickup means being integrally connected with the vacuum carrier means, the at least two vacuum pickup means and the vacuum carrier means having there between established diverting means to divert the created vacuum conducted by the vacuum carrier means from any of the at least two vacuum pickup means; preferably the vacuum pickup means being disposed proximate the bottom of the cleaning attachment and the openings extending substantially normal to the direction of travel of the cleaning attachment in use; preferably the cleaning attachment having at least one rotatable cleaning means, preferably reversible in its direction of rotation, preferably situated between the at least two vacuum pickup means, the at least one rotatable cleaning means driven by powered driving means preferably located within the cleaning attachment; whereby in use the cleaning attachment may be used to vacuum or wash surfaces.

According to another aspect of the invention, an improved cleaning attachment for a powered cleaning unit is provided, the cleaning attachment comprising a three dimensional frame having a bottom, top, front, rear, and two sides, the cleaning attachment having extending therefrom vacuum carrier means for conducting a created vacuum, the vacuum carrier means extending away from the three dimensional frame, the three dimensional frame having liquid supply means extending to a source of liquid supply away from the three dimensional frame, the liquid supply means having liquid distribution means connected thereto; the cleaning attachment having disposed at the bottom thereof at least two vacuum pickup nozzles each having an opening therein, the at least two pickup nozzles being integrally connected with the vacuum carrier means, the two vacuum pickup nozzles and the vacuum carrier means having therebetween established diverting means to divert the created vacuum conducted by the vacuum carrier means from any of the at least two vacuum pickup nozzles; the vacuum pickup nozzles being disposed proximate the bottom of the cleaning attachment whose openings extend substantially normal to the direction of travel of the cleaning attachment in use; preferably the cleaning attachment having at least one rotating cleaning brush, (preferably being reversible) preferably situated between the at least two vacuum nozzles, the at least one rotating cleaning brush being driven by powered driving means preferably located within the cleaning attachment, whereby in use said cleaning attachment may be used to vacuum or wash surfaces.

According to yet another aspect of the invention, the cleaning attachment may comprise a forward vacuum nozzle which pivots up and down from a position proximate the surface to be cleaned to a position remote the surface to be cleaned.

According to yet another aspect of the invention, the cleaning attachment may comprise a forward vacuum means which pivots up and down from a position proximate the surface to be cleaned to a position remote the surface to be cleaned.

According to another aspect of the invention, the cleaning attachment may comprise diverting means which is a diverter valve comprising a substantially rectangular box having a top, bottom, front, rear and two sides, the box having disposed at its rear a fitting connected to the vacuum carrier means, the box having disposed at its front at least two openings which are connected to the at least two vacuum nozzles, the box having disposed at the front thereof adjacent the at least two openings, a substantially rectangular vertically disposed plate which is slideable from side to side within the box to cover any of the at least two openings and thereby divert the vacuum from any of the at least two vacuum nozzles.

According to another aspect of the invention, the cleaning attachment may comprise diverting means which is a diverter valve comprising a substantially rectangular box having a top, bottom, front, rear and two sides, the box having disposed at its rear a fitting connected to the vacuum carrier means, the box having disposed at its front at least two openings which are connected to the at least two vacuum means, the box having disposed at the front thereof adjacent the at least two openings, a substantially rectangular vertically disposed plate which is slideable from side to side within the box to cover any of the at least two openings and thereby divert the vacuum from any of the at least two vacuum means.

According to another aspect of the invention, the cleaning attachment may comprise diverting means which is a ball valve.

According to another aspect of the invention, the cleaning attachment may comprise diverting means which is a flip flop gate.

According to yet another aspect of the invention, the cleaning attachment is installed within a self-contained vacuum unit.

According to another aspect of the invention, the cleaning attachment may comprise an effluent receiver for receiving effluent when the cleaning attachment is used for washing surfaces, the effluent receiver for preventing the effluent from reaching a vacuum generating blower.

According to yet another aspect of the invention, a conversion kit for a central vacuum system is provided, the kit comprising a float having a top for retention in a substantially vertical orientation when installed within the lower chamber of a central vacuum system wherein the waste materials are collected, the float having an extension means extending from the top of the float, the extension means having a stop means extending proximate the top of the extension means for use in stopping the vacuum provided by a vacuum blower within a central vacuum system by covering the inlet of a vacuum blower when the float is raised to a predetermined level within the lower chamber of a central vacuum system whereby the stop means will block the inlet of a vacuum blower and prevent effluent from contacting the blower.

According to yet another aspect of the invention, a conversion kit for a wet vacuum is provided, the kit comprising a float having a top for retention in a substantially vertical orientation when installed within the lower chamber of a wet vacuum wherein the waste materials are collected, the float having an extension means extending from the top of the float, the extension means having a stop means extending proximate the top of the extension means for use in stopping the vacuum provided by a vacuum blower within a wet vacuum by covering the inlet of a vacuum blower when the float is raised to a predetermined level within the lower chamber of a wet vacuum whereby the stop means will block the inlet of a vacuum blower and prevent effluent from contacting the blower.

According to yet another aspect of the invention, the cleaning attachment may comprise a sheath which fully encapsulates the vacuum carrier means and the liquid supply means.

According to yet another aspect of the invention, cleaning solution addition means may be provided in combination with the liquid supply means.

According to yet another aspect of the invention, the liquid supply means may comprise a tubular hose connected to a household tap.

According to yet another aspect of the invention, the liquid supply means may comprise a tubular hose connected directly to a source of liquid supply.

According to another aspect of the invention, spray means extend from the liquid supply means adjacent the front of the attachment.

According to yet another aspect of the invention, the cleaning attachment may comprise two vacuum pickup nozzles, the first nozzle centrally located within the three dimensional frame for use as a vacuum nozzle having an opening located at the bottom thereof substantially for picking up dry waste materials from a surface being cleaned, the second nozzle located proximate the front of the three dimensional frame for use as a vacuum pickup nozzle having an opening located at the bottom thereof, the opening of substantially reduced cross section to the front nozzle for picking up of wet effluent and waste materials from a surface being cleaned. For example, the first nozzle may have an opening of 1½" while the second may have an opening of ¼".

According to yet another aspect of the invention, a receptacle may be provided for use with a vacuum system incorporating fluid supply means and vacuum inlet means therein.

According to yet another aspect of the invention, a receptacle is provided for use with a central vacuum system, said receptacle extending through a wall, the receptacle comprising a housing for fastening to a wall, the housing having disposed therein fluid supply means and vacuum inlet means.

BRIEF DESCRIPTION OF THE DRAWINGS

FIGS. 9 and 9A are illustrations of the cleaning head being used with the central vacuum system in an alternative embodiment of the invention.

FIGS. 10 and 10A are schematic views of the instant invention being used with a central vacuum system as illustrated in FIGS. 9 and 9A, but used as a washing device having an effluent receiver installed within the system in an alternative embodiment of the invention.

FIGS. 11 and 11A are schematic illustrations of the cleaning head used as a washing unit similar to that illustrated in FIGS. 10 and 10A, but having a conversion kit installed within the central vacuum unit to receive the effluent extracted from the surface being cleaned in an alternative embodiment of the invention.

DETAILED DESCRIPTION OF THE PREFERRED EMBODIMENTS

Figure 1:
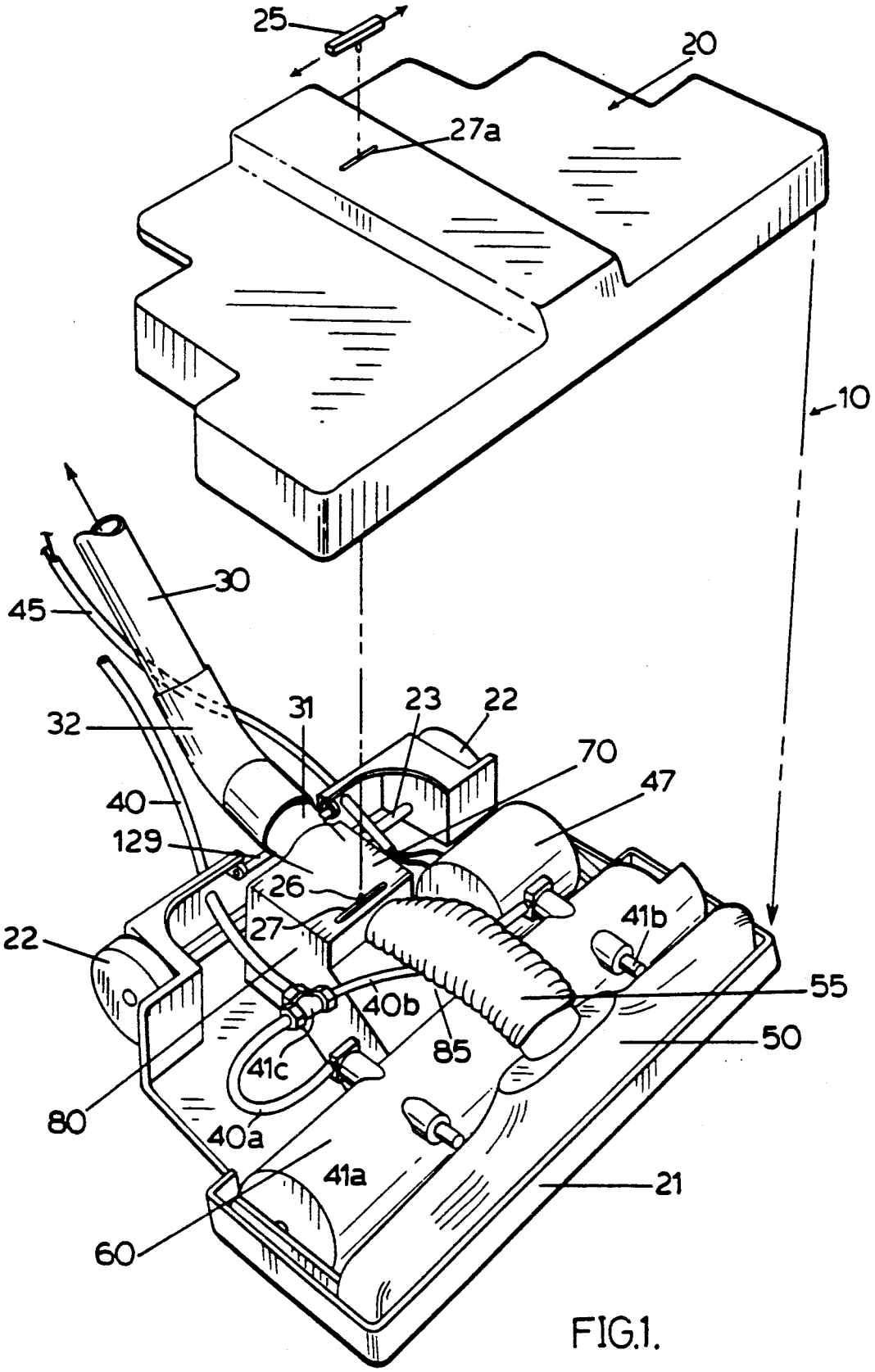
FIG. 1 is a perspective view of the cleaning head with the top portion removed to reveal the internal components in a preferred embodiment of the invention.
Figure 3:
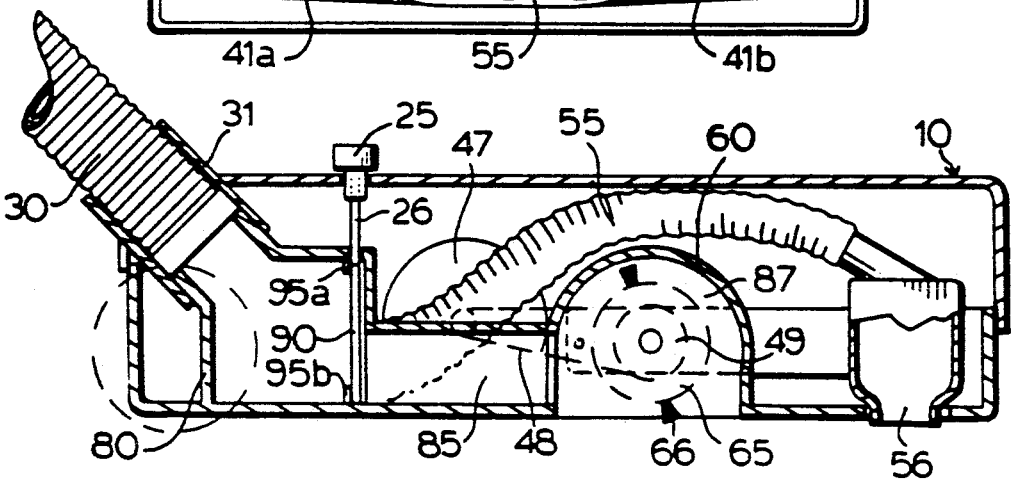
FIG. 3 is a side view of the cleaning head of FIG. 1 in a preferred embodiment of the invention.
Figure 4:
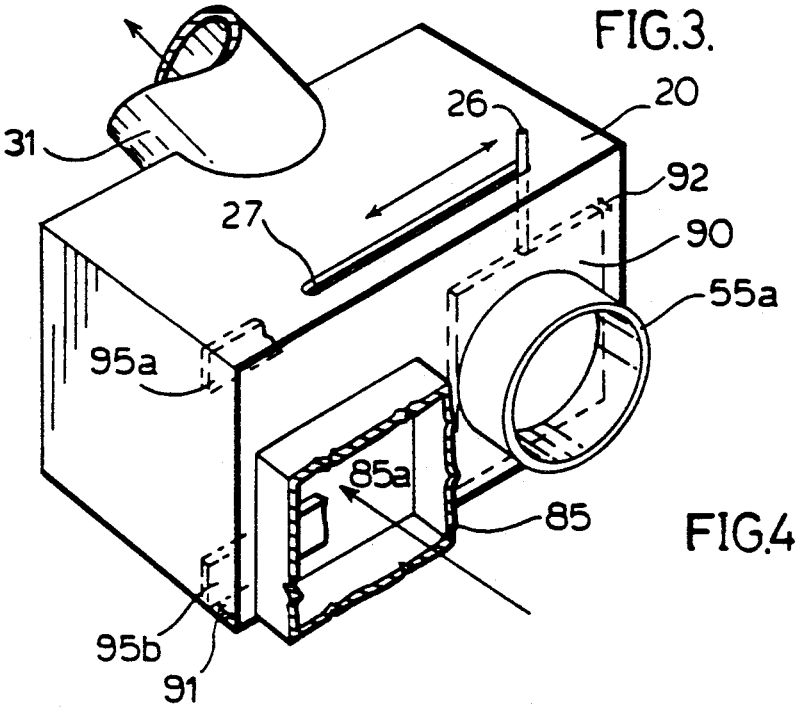
FIG. 4 is a perspective view of the diverter mechanism illustrated in close up in a preferred embodiment of the invention.
Figure 5:
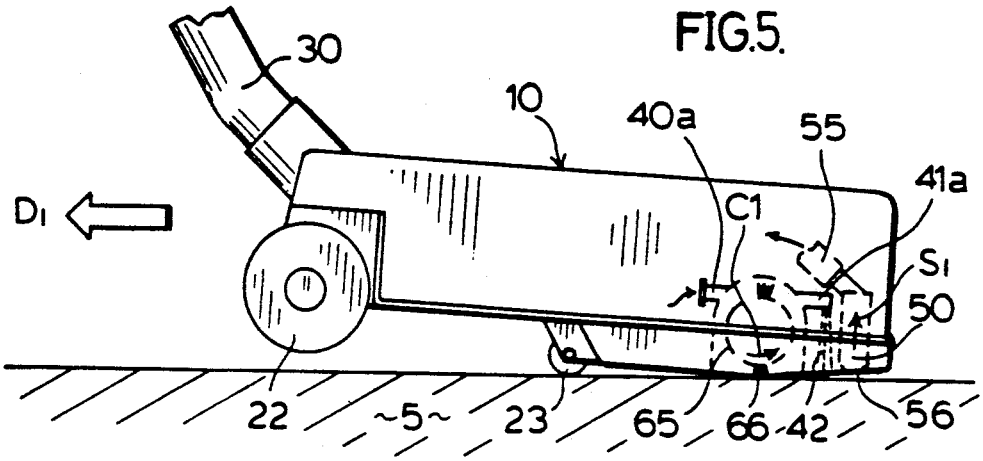
FIG. 5 is a side view of the cleaning head in use as a carpet cleaning or washing apparatus in a preferred embodiment of the invention.
Figure 6:
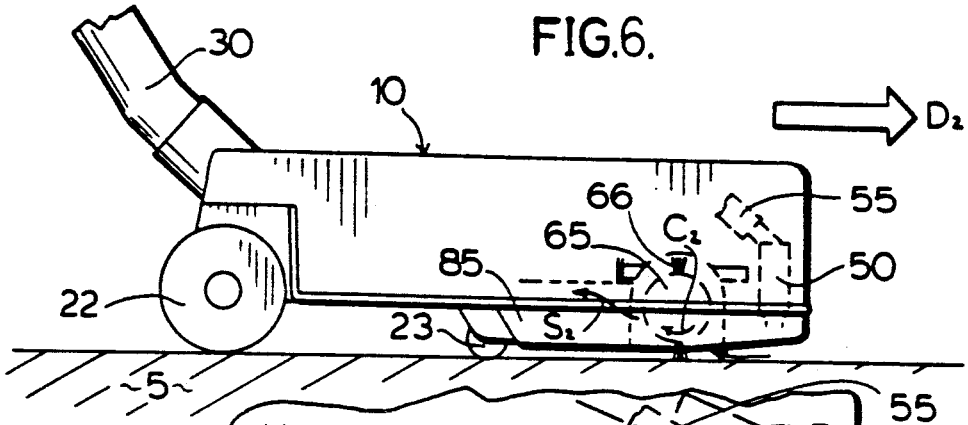
FIG. 6 is a side view of the instant invention in use as a regular vacuum cleaning device in a preferred embodiment of the invention.

Referring now to FIG. 1, cleaning head 10 is illustrated in perspective having a top 20 and a bottom 21 within which the components of the cleaning head are contained. The cleaning head 10 has a front and a rear and two sides and has disposed at the rear a vacuum tube 30 affixed to the rear of the cleaning head 10 at nipple 31 by elbow 32. The vacuum tube 30 may extend to any conventional vacuum creating device and is used to carry the soiled materials away from the surface being cleaned. The connection at 31 may be a quick connect or a pin connection as required. The cleaning head 10 has contained therein a diverting mechanism 80 as best illustrated in FIG. 4 for diversion of the vacuum created from either the nozzle 50 disposed at the front of the cleaning head, or the nozzle 60 disposed centrally, both nozzles extending from side to side of the cleaning head 10. A flexible spiral tube 55 extends from the diverter mechanism 80 forwardly to the nozzle 50, and the substantially rectangular chamber 85 extends from the diverter mechanism 80 to the nozzle 60. Thus, a vacuum may be applied forwardly or centrally or consecutively, within the cleaning head. It is also conceivable that the diverter mechanism 80 may be designed such that vacuum may be applied at more than two positions or at wherever the vacuum may be required for the specific application. For example, vacuum may be needed primarily about the perimeter of the cleaning head 10. Nozzles may be laid out in a similar manner with carrier means conveniently positioned to accomplish this task. The cleaning head 10 further has a tube 40 for carrying liquid, usually water with a cleaning solution contained therein, from the source of the water or liquid supply to the forward nozzles 41A and 41B positioned adjacent the forward nozzle 50 of the cleaning head 10. A t-shaped fitting at 41C is provided to split the flow of the liquid through tube 40 into supply tubes 40A and 40B respectively. The nozzles 41A and 41B are selected to in unison provide a spray pattern resembling a fan shape to cover the entire side to side dimensions of the cleaning head 10. It is also possible, of course, to provide more nozzles each providing a slimmer fan-shaped spread upon the surface to be cleaned. Further, the spray nozzles may be placed forward of the vacuum nozzle 50 if desired, or they may be placed both forward and rearward of the vacuum nozzle 50 if desired. In an alternative embodiment, the vacuum nozzles are placed both forwardly and rearwardly, but such an alternative embodiment is not illustrated. The main positioning of the spray nozzles in relation to the vacuum nozzle 50 is a function of the direction of motion of the cleaning head 10 when used as a surface washing device. Power head 10 has contained therein a drive motor 47 for driving a brush as best illustrated in FIG. 3. Wheels 22 are conveniently located at the rear of the cleaning head 10 to provide the easy manipulation of the cleaning head. Drive motor 47 is reversible through conventional methods to thereby reverse the direction of rotary brush 65 as best illustrated in FIGS. 5 and 6. Such a reversing may be accomplished by conventional methods such as providing switch mechanisms which reverse the polarity of the drive motor or by providing the necessary gearing and drive reductions to drive the brush 65 in either direction. For the preferred embodiment, it is intended that the drive motor 47 is reversible by a switch mechanism located at the top of the electrical lead 45 adjacent the cleaning head operator. It is preferable that drive motor 47 be reversible, but it is not absolutely necessary, however, such reversing improves the cleaning efficiency of the cleaning head 10. The nozzle 60 within which the brush 65 is contained is compatibly shaped with the brush 65 and provides a housing for the brush 65. Vacuum tube 30 may be connected to nipple 31 or an alternative joint 32 which allows the vacuum tube 30 to be swivelled to a multiplicity of positions to allow the user to use the cleaning head 10 under a range of furnitures under which conventional cleaning heads cannot be used.

Figure 2:
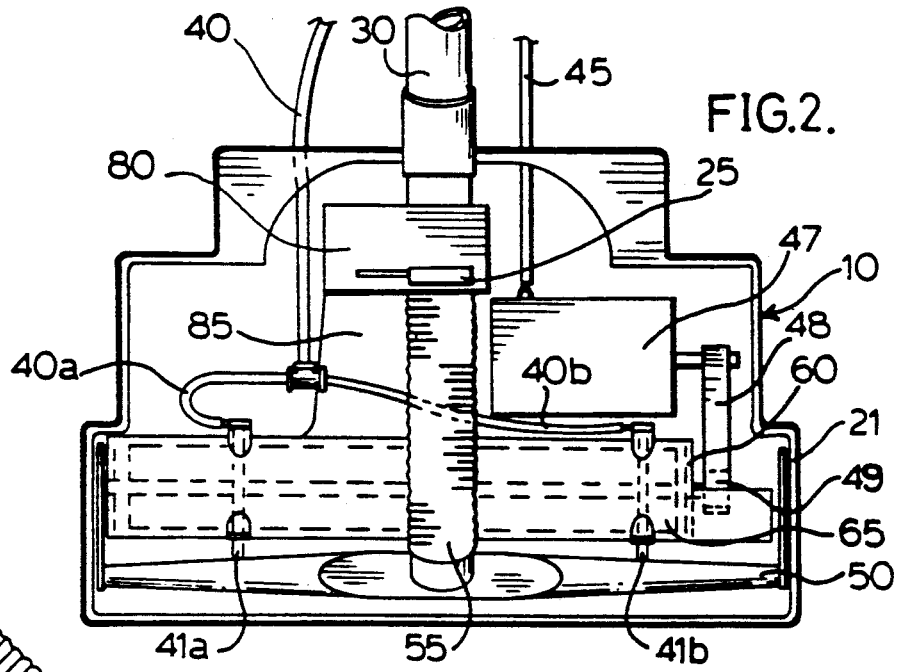
FIG. 2 is a top view of the cleaning head of FIG. 1 illustrating the relative positions of the components thereof in a preferred embodiment of the invention.

Referring now to FIG. 2, the cylindrical brush 65 is illustrated within nozzle 60 being driven by drive motor 47 via drive belt 48 and pulley 49. As mentioned, the drive motor 47 is reversible which allows the brush 65 to be driven in either direction, the significance of which will be best described in relation to FIGS. 5 and 6. Nozzles 41A and 41B are positioned to the rear of nozzle 50 for optimum performance of the cleaning head 10 in the surface washing mode of operation. FIG. 2 further illustrates the positioning of flexible tube 55 and rectangular chamber 85 and their abilities to supply both vacuum nozzle 50 and vacuum nozzle 60, depending on the positioning of slide handle 25. When slide handle 25 is positioned as illustrated in FIG. 2, the vacuum created external to the cleaning head 10 and drawn through vacuum tube 30 will be applied to the nozzle 60 as best illustrated in FIG. 4. If the handle 25 were positioned at the opposite extreme of that position illustrated in FIG. 2, then the vacuum would be applied through vacuum tube 30 through to nozzle 50 through flexible tube 55. It is not necessary that the tubing 55 be flexible, but it is more convenient when assembling cleaning head 10 that the tubing be flexible. It is equally possible that a permanent connector may be provided similar to the structure of item 85.

Referring now to FIG. 3, cleaning head (10) is illustrated in side view to show the relationship between the drive 47 and the brush 65 contained within nozzle 60 where an opening 87 is defined within which the brush 65 will rotate. The brush 65 has bristles 66 conveniently located about its circumference, the brush being substantially cylindrical in shape. The bristles 66 may be uniformally distributed about the perimeter of the brush cylinder 65 or may be of a suitable pattern which improves the scrubbing ability of the brush 65. The drive 47 is reversible and provides driving motivation for the brush via drive shaft 55 and belt 48 through pulley 49. Chamber 85 is illustrated having its end adjacent the diverting mechanism 80 open to allow any vacuum applied through the tube 30 to be directed towards nozzle 60, when the vacuum is required through that nozzle. Alternatively, if the handle 25 is positioned in the opposite position illustrated in FIG. 2, Chamber 85 would be blocked proximate diverter mechanism 80 and flexible tube 55 would then be clear to provide vacuum to the forward nozzle 50 when such a mode of operation is required. Such movement of the handle 25 in relation to shaft 26 is best illustrated in FIG. 4.

Referring now to FIG. 4, diverter mechanism 80 is illustrated having a substantially rectangular body with a top, bottom, front and rear having disposed at the rear thereof the nipple 31 for connection with the vacuum tube 30 and having disposed at the front thereof vacuum channel 85 and nipple 55A for attachment to the flexible tubing 55. A horizontal slot 27 is provided on the top of the diverting mechanism within which shaft 26 connected to handle 25 will move. Shaft 26 has fixed at the bottom thereof substantially rectangular plate 90 which moves within a space 91 defined between the forward face of the diverting mechanism 80 and retaining plates 95A and 95B disposed proximate the forward face of the diverting mechanism at the top and bottom thereof. The space 91 is substantially equal to the width 92 of the rectangular plate 90. Thus rectangular plate 90 will be moved from a position substantially covering the opening 56 blocking any vacuum from the forward nozzle 50, to a position substantially blocking the opening 85A and preventing vacuum from being applied to the nozzle 60. In alternative embodiments of the invention which are not illustrated, the diverting mechanism 80 may incorporate a flip flop valve which pivots the gate 90 about a pivot point and an arcuit path to pivot from its position blocking the opening 56 to a position blocking opening 85A. In providing such a flip flop valve, it is also necessary to provide resilient biasing means to hold the flip flop valve in position covering 85A or opening 56 respectively. Further, a ball valve of sufficient size may be used wherein the opening through the ball valve may be aligned with either opening 56 or opening 85A in its conventional use. It is however, recommended that the sliding mechanism illustrated in FIG. 4 be used as it is the most economical and the simplest device known to myself at this time.

Referring now to FIG. 5, the cleaning head 10 is illustrated in use as a surface washing device, washing surface 55 wherein auxilliary wheel 23 is illustrated. The drive motor is rotating in such a direction such that the brush 65 rotates in a counter clockwise direction Cl as illustrated. Bristles 66 thus scrape the dirt or grime forwardly towards the spray nozzle 40A instantaneously cleaning the surface 5 wherein liquid spray 42 is applied to the dirt or grime which is readily suspended in the cleaning solution at spray 42 and subjected to the continual agitation of bristles 66. The vacuum nozzle 50 is then drawn over the soil which has been suspended in the cleaning solution in a direction D1 causing the wet effluent to be lifted up on the direction S1 through opening 56 of nozzle 50, carrying the soiled effluent through flexible tubing 55 on up through vacuum tubing 30. Such a mode of operation, of course, is used, for example, for the cleaning of carpets when the carpets are in a condition to be cleaned. The handle 25 as illustrated in FIG. 4 would be positioned such that rectangular plate 90 is covering opening 85A, thus allowing the vacuum to be applied through opening 56 through nozzle 50 to surface 5 at opening 56. Opening 56 is of a substantially reduced cross section in order to increase the velocity of the air being drawn up through nozzle 50, such velocity required when picking up heavy wet materials unlike the velocities required during dry vacuuming.

Figure 7:
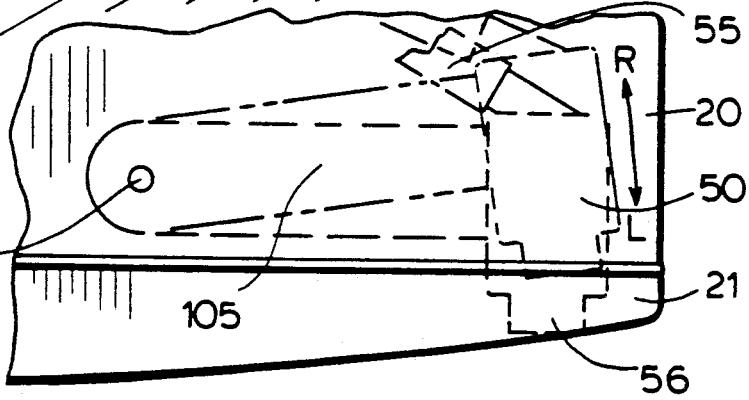
FIG. 7 is a close up side view of the nozzle 50 used in spray washing the surface being cleaned illustrating the retraction thereof in a preferred embodiment of the invention.

Referring now to FIG. 6 and 7, cleaning head 10 is being used as a dry vacuum unit for cleaning surface 5 wherein drive motor 47 is operating in such a direction to drive cylindrical brush 65 in a clockwise direction C2. Such rotation of brush 65 in direction C2 will cause bristles 66 to scrub any soil or dirt towards the vacuum chamber 85 which is clear to receive the dirt, as best illustrated in FIG. 4, in that rectangular plate 90 is substantially positioned to inactivate the opening 56 of flexible tube 55. Thus, when the cleaning head 10 is moved in direction D2, the surface 5 will be scrubbed by the rotation of brush 65 in a clockwise direction C2 by bristles 66. However, nozzle 50 will have been pivoted or retracted into a position of storage, as best illustrated in FIG. 7 by the pivotting of bracket 105 about pivot 100 which connects through to nozzle 50. The nozzle 50 can be raised in direction R or lowered in direction L within the top portion of 20 of cleaning head 10. Thus, it is advantageous if hose 55 is flexible to allow such retraction of nozzle 50 from a position wherein opening 56 is proximate the surface 5 to a position wherein opening 56 is remote the surface 5.

Figure 8:
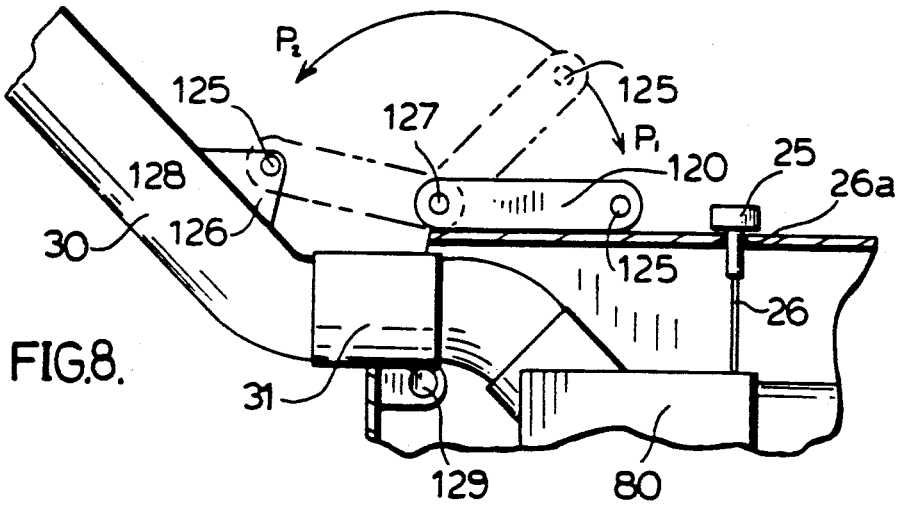
FIG. 8 is a close up side view of a bracket mechanism used to lock the tubing 30 in an upright position when the cleaning head is being used as a washing unit in a preferred embodiment of the invention.

Referring now to FIG. 8, a locking mechanism is illustrated used in conjunction with vacuum tube 30 having fastened thereto substantially rectangular portion 126 having a pivot 127 wherein substantially rectangular bracket 120 pivots from a position P1, wherein the tube 30 is free to rotate in any direction wherein the pin at 125 is located substantially proximate P1, to a position wherein pin 125 is located substantially proximate the triangular bracket 126, wherein the pin 125 is inserted through an opening 128 through bracket 126 where at pin 125 is locked, such locking being accomplished by conventional methods. A bolt 129 is further positioned at the bottom of nipple 31 to secure the said nipple to the cleaning head 10.

Figure 9:
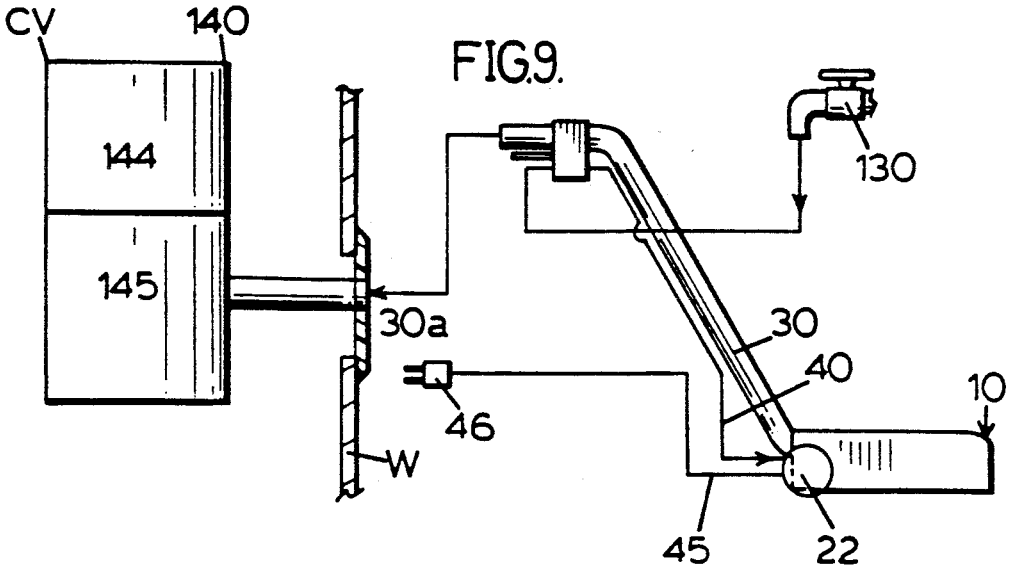

Referring now to FIG. 9, the cleaning head 10 is used in conjunction with a central vacuum system, such use being illustrated in schematic form in FIG. 9. The cleaning head 10 is being used as a vacuum cleaning head wherein the dirt is being brushed towards nozzle 60 and being carried toward the central vacuum system CV, having a top portion 144 and a bottom portion 145. The top portion at 144, as in conventional central vacuum systems, contains the vacuum blower, wherein the bottom portion 145 is the dirt receiving portion of the central vacuum system wherein through cyclonic action the air will enter into 145 and be circulated to drop the dirt to the bottom of 145. Inlet 30A for vacuum tube 30 is provided as an inlet to the vacuum system and plug 46 is provided to plug into a conventional household plug. There may, of course, be a switch apparatus between the power cord 45 and the plug 46 for controlling the direction of motor 47, but such a switch is not shown. The liquid supply tubing 40 is illustrated connected to a tap 130 by conventional methods. It is, of course, advantageous if such a connection would be made via a typical quick connect as found in dishwashers. However, the attachment need only be secure to withstand the conventional pressures found in waterlines in households. Thus, the cleaning head 10 is set up to be used with a central vacuum system as a vacuum sweeper, but liquid is being provided at 130 so that the user may conveniently wash the carpets following the vacuum cycle. Of course, it is also understood that the liquid supply tube 40 may be connected via quick connect to a permanent waterinstalled for the use with the cleaning head 10. It is also recommended that hot water be used, but this will depend on the detergent being used along with the water.

Figure 10:
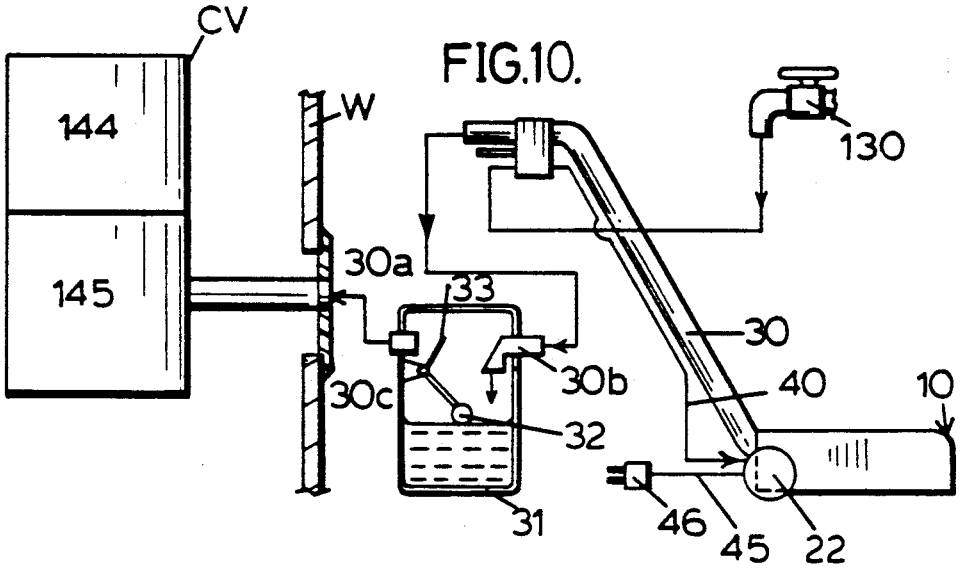

Referring now to FIG. 10, the cleaning head 10 is illustrated being used with a central vacuum system having an effluent receiving container 31 connected between the inlet 30A and the tube 30 for receipt of any wet effluent through opening 30B which will act in essence as a trap and avoid any harm coming to the vacuum blower contained within the portion 144 of the central vacuum unit. In FIG. 10, the cleaning head is being used as a surface washing device, the effluent entering port 30B of receiver 31 wherein float mechanism 32 is provided having at its extreme a rectangular plate 33 for covering the exit 30C to ensure that if the effluent arises to a point where it might carry over into the power portion 144 of the central vacuum system that such a rectangular plate would block such exit.

Figure 11:
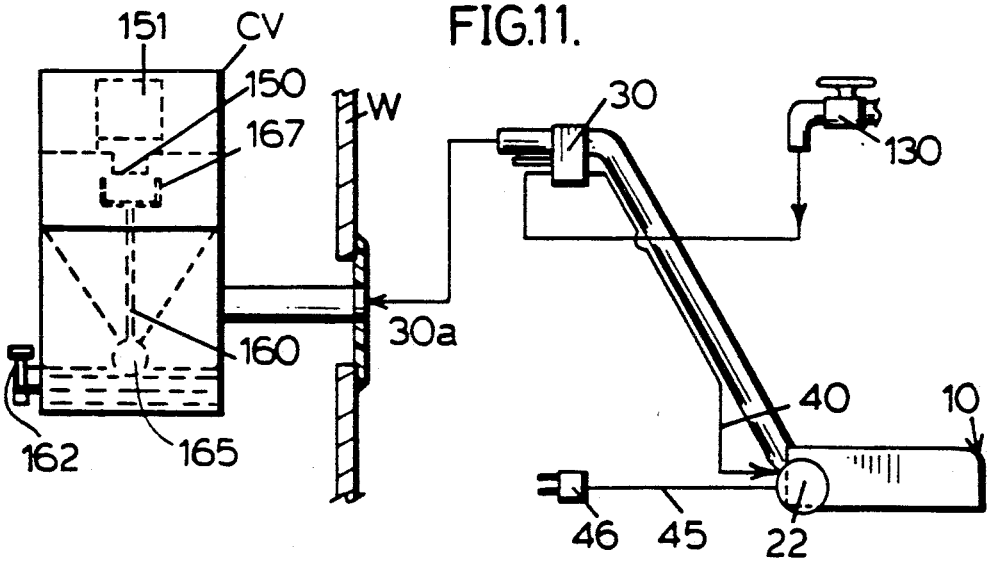

Referring now to FIG. 11 wherein cleaning head is being used as illustrated in FIG. 10, however the effluent receiving portion of the system is being contained within the central vacuum system itself. A kit has been provided to convert the central vacuum system to be able to handle the effluent wherein a float mechanism 160 is provided having a float 165 at the bottom thereof, the float mechanism 160 for covering the opening 150 of the vacuum blower 151 should the float rise to a predetermined level wherein the blower would be contaminated with soiled effluent, the cover plate portion 167 would block the opening 155 thereby preventing any introduction of the effluent to the blower 151. The drain 162 is provided in the conversion kit to allow for draining the effluent from the portion 145 of the central vacuum system. A pump, of course, may be provided connected to the drain which may be intermittently engaged for handling the effluent to the sewer as required. Such embodiments illustrated in FIG. 9 through 11 are alternative embodiments of the invention, and it is not inferred in any way that cleaning head 10 may be used only with a central vacuum system.

Referring now to FIGS. 9A, 10A and 11A, the cleaning head is illustrated in direct correspondence with FIGS. 9, 10 and 11 with the exception that tap 130 is eliminated in these views and a water supply outlet C is provided incorporated in the receptacle 30A in each of the afore-mentioned figures. Typically such a receptacle is provided when a central vacuum system is used in combination with the instant invention. However, the receptacle may be used separate of the instant invention as well.

Figure 13:
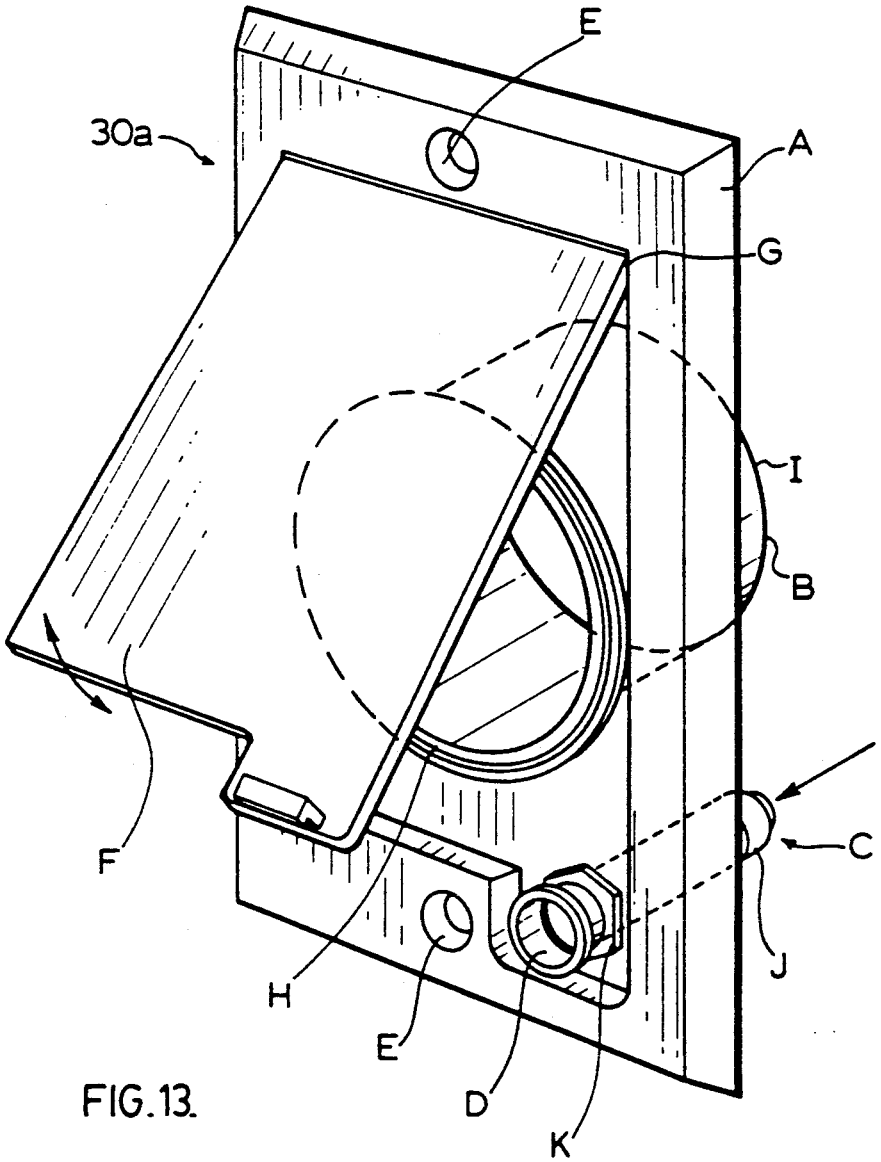
FIG. 13 is a perspective view of the receptacle 30A isolated from the system as described in FIGS. 9A, 10A and 11A.

Referring now to FIG. 13, such a receptacle 30A is provided having a generally rectangular housing A with a vacuum inlet nozzle B extending therethrough. Further a water supply nozzle C is incorporated in the housing having a quick connect D and a check valve J embodied therein for convenience sake. The nozzle B has a front and rear, H and I respectively. H extends to the vacuum tool and I extends to the vacuum source. Mounting holes E are provided for convenient mounting to the wall. Further, a cover F is provided hinged at G for convenience of the user as is known in the art of receptacles.

Figure 12:
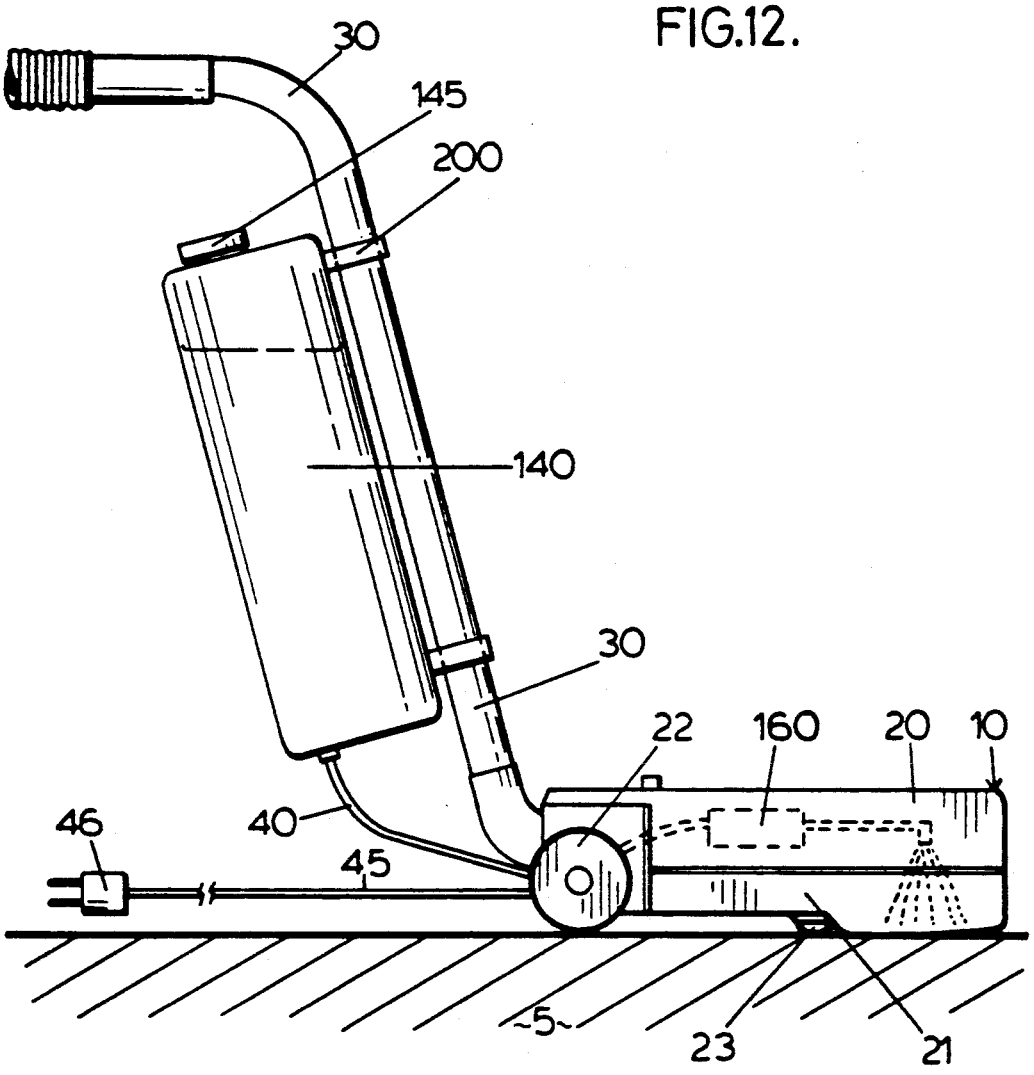
FIG. 12 is a schematic illustration of the cleaning head used in a stand alone application similar to that of FIG. 10, but having a separate supply of clean liquid to wash the surface being cleaned in an alternative embodiment of the invention.

Referring now to FIG. 12, cleaning head 10 is illustrated in use in a stand alone upright vacuum system having a receiver 31 (not shown) as illustrated in FIG. 10 connected to tube 30 at the end thereof remote the cleaning head 10, having a separate water supply 140 provided connected to the tube 30 at brackets 200 wherein the liquid 140 is a mixture of water and the specific detergent being used. A pump 150 is conveniently provided within the cleaning unit to pump the liquid at a metered rate through the nozzles 40A and 40B towards surface 5. Such an illustration as shown in FIG. 12 is an alternative embodiment of the invention; other alternatives also exist, and the use of the instant invention is only limited by the imagination of the designer.

Thus, a convenient cleaning attachment has been invented which may be used with, but not limited to, a multiplicity of vacuum devices with a minimum of effort by the user. A central vacuum system may be modified as discussed in the aforementioned sections to use the cleaning head as both a vacuum and a wet washing attachment. Similarly, a portable wet vacuum of conventional design may be modified to use the instant invention. However, if modification is undesirable, a receiver for the effluent as drawn from a soiled carpet may be used as best illustrated in FIG. 10, but not limited by any means to the use of the receiver with a central vacuum system only. Such a receiver may be adapted to be used with just about any vacuum on the market today. All that is necessary is for the attachment to be effectively connected to a source of vacuum, whether it be a canister-type vacuum cleaner having a disposable bag, or whether it be a more complicated system such as a wet/dry vacuum cleaner. It is, of course, not necessary to use a reversing drive as suggested in the preferred embodiment, however, such a reversing drive provides effective agitation of the soiled carpet in the preferred direction when the vacuum cleaning attachment is used, or when the surface cleaning attachment is used. Such agitation of the soil in the carpet may be in one direction, but the effectiveness of the unit overall may be reduced.

As best illustrated in relation to FIGS. 5 and 6, it is preferred that the surface cleaning be attempted by reversing the cleaning brush's direction of rotation, as shown in FIG. 5, and by moving the cleaning attachment in a direction D1 as illustrated. By movement of the cleaning attachment in direction D1, superior results are achieved, but movement of the attachment when cleaning surface 5 via spray 42 may be achieved by moving the cleaning head forwardly as well. FIG. 6 illustrates the preferred direction of motion for the cleaning attachment when used as a dry vacuum pick up. However, of course, if the vacuum attachment were moved in direction D1, satisfactory results would be obtained as well. The purpose in establishing the preferred direction D1 in carpet cleaning for example is that the weight is not available as, for example, in a commercial carpet cleaning unit, and the rotation of the brush in the counter clockwise direction becomes even more important in obtaining satisfactory results.

As many changes can be made to the preferred embodiments of the instant invention without departing from the scope of the invention; all descriptions herein to be interpreted as illustrative of the invention and not in a limiting sense.

The embodiments of the invention in which an exclusive property of privilege is claimed are as follows:

1. An improved integrated cleaning attachment for both dry vacuuming or wet cleaning carpets, upholstery or the like, for use with a powered cleaning unit, the cleaning attachment comprising a three dimensional frame having a top and bottom, the cleaning attachment having extending therefrom vacuum carrier means for conducting a created vacuum from a source of created vacuum to the three dimensional frame, the three dimensional frame having liquid supply means extending to a source of liquid supply away from the three dimensional frame, the liquid supply means having liquid distribution means connected thereto, the cleaning attachment having disposed therein proximate the bottom thereof at least two vacuum nozzle means, each having an opening therein, each opening extending substantially horizontally above a surface being cleaned, the at least two vacuum nozzle means and the vacuum carrier means having therebetween established diverting means to divert the created vacuum conducted by the vacuum carrier means from any of the at least two vacuum nozzle means, the cleaning attachment having there disposed at least one rotatable cleaning means; whereby in use the cleaning attachment may be used to dry vacuum or wash and wet vacuum carpets, upholstery or the like, wherein a standard size receptacle for use with the powered cleaning unit is provided, said receptacle extending through a wall, the receptacle carrying a housing for fastening to a wall, the housing having disposed therein fluid supply means and vacuum inlet means, the fluid supply means incorporating a quick connect and a check valve.

* * * * *